US006341668B1

(12) United States Patent
Fayette et al.

(10) Patent No.: US 6,341,668 B1
(45) Date of Patent: Jan. 29, 2002

(54) INTERACTIVE ELEVATOR COMMUNICATION SYSTEM

(75) Inventors: Peter T. Fayette, San Diego, CA (US); Charles Jenkins, Sawanee, GA (US)

(73) Assignee: Televator One, LLC, San Diego, CA (US)

( * ) Notice: Subject to any disclaimer, the term of this patent is extended or adjusted under 35 U.S.C. 154(b) by 0 days.

(21) Appl. No.: 09/542,029

(22) Filed: Apr. 3, 2000

(51) Int. Cl.[7] ..... B66B 1/34
(52) U.S. Cl. ..... 187/391; 187/247; 187/382
(58) Field of Search ..... 187/247, 391, 187/396, 392, 394, 380, 381, 382

(56) References Cited

U.S. PATENT DOCUMENTS 4,839,631 A * 6/1989 Tsuji ..... 187/105
4,995,479 A * 2/1991 Fujiwara et al. ..... 187/135
5,007,506 A * 4/1991 Suzuki et al. ..... 187/101
5,042,620 A * 8/1991 Yoneda et al. ..... 187/124
5,131,508 A * 7/1992 Suzuki ..... 187/132
5,606,154 A * 2/1997 Doigan et al. ..... 187/396
5,714,726 A * 2/1998 Ketoviita ..... 187/391
5,952,626 A * 9/1999 Zaharia ..... 187/381
5,955,710 A * 9/1999 DiFranza ..... 187/396
6,082,500 A * 7/2000 Amo ..... 187/391
6,206,142 B1 * 3/2001 Meacham ..... 187/392

FOREIGN PATENT DOCUMENTS

JP 5-254746 * 10/1993

* cited by examiner

*Primary Examiner*—Jonathan Salata
(74) *Attorney, Agent, or Firm*—Baker & McKenzie

(57) ABSTRACT

The elevator communication system generally provides a computer device installed in an elevator cab. The computer device is configured with peripheral devices to display visual and audio information to cab riders. The computer device receives information content from several sources, including a networked server system. The server system communicates information to the computer device for presentation to passengers in the elevator. The computer device may also be connected to an elevator controller so that the computer device can present information based on current and future destination floors of the elevator cab. The elevator communication system queues and orders the received informational content based on received selection data, thereby selecting which information is presented to elevator riders.

26 Claims, 4 Drawing Sheets

INTERACTIVE ELEVATOR COMMUNICATION SYSTEM

FIELD OF THE INVENTION

The field of the present invention is communications systems. More particularly, the field relates to a computer directed communication system configured for use in the cab of an elevator system.

BACKGROUND OF THE INVENTION

Elevators are a ubiquitous aspect of modern life. Generally, elevators propel an elevator cab vertically to assist moving passengers and cargo between the floors of a multifloor building. In larger buildings, banks of elevators can be used to move people more efficiently. The typical elevator cab is constructed as a small box, with sliding doors that allow passengers to enter and exit. With the doors closed, the passenger or passengers are enclosed within the cab until the cab reaches a next destination floor. Although the typical elevator ride lasts only a short time period, many people find the ride uncomfortable. For some, a feeling of claustrophobia can turn the ride into a heart-racing panic. Such a response is not only uncomfortable for the person having the panic attack, but also can frighten or disturb any other passengers.

Even without claustrophobia, an elevator ride can be awkward. For example, the elevator ride may force total strangers to be in close bodily contact, a physical relationship that violates the normal personal spacing of some cultures. Although crammed closely together, the social norms in an elevator suggest that social discourse be avoided and everyone look forward. Thus a typical elevator ride may entail awkwardly watching the floor indicator lights, and anxiously waiting for the doors to open on a destination floor.

To make the elevator ride more comfortable, building managers may provide music into the elevator cab, or provide informational panels on the cab's walls. Such minor distractions, however, do not provide a sufficient focal point for the elevator passengers. The informational panels simply provide a static display such as printed advertising for a local restaurant or bar. As to the music feed, the popular perception is that music in an elevator is unsatisfactory. For example, "elevator music" is a phrase generally applied to dull, unappealing music.

When entering a building for the first time, it is often necessary to get directions from a directory board or a security guard. Building directory boards are often not current, and security personnel may be busy attending to other matters. Thus, finding your destination, or even what floor your destination is on, can be frustrating and time-consuming. Further, when exiting on a destination floor, it is often difficult to know which way to go. Not only can this waste time, but difficulty in finding the final destination is simply annoying and can be stressful.

Thus, there exists a need for enhancing the quality of an elevator ride. In such a manner, not only is there a need to make elevator riders more comfortable, but there is a need to present them with timely information.

SUMMARY OF THE INVENTION

It is therefore an object of the present invention to enhance the quality of an elevator ride. It is a further object of the present invention to provide a focal point of information for an elevator rider. Therefore, to overcome the deficiencies in the known systems and to meet the identified objectives, an elevator communication system is disclosed. Briefly, the elevator communication system generally provides a computer device installed in an elevator cab. The computer device is configured with peripheral devices to display visual and audio information to cab riders. The computer device receives information content from several sources, including a networked server system. The server system communicates information to the computer device for presentation to passengers in the elevator. The computer device may also be connected to an elevator controller so that the computer device can present information based on current and future destination floors of the elevator cab. The elevator communication system queues and orders the received informational content based on received selection data, thereby selecting which information is presented to elevator riders.

Advantageously, the elevator communication system eases the stress of riding an elevator by providing an active, prominent presentation of information. Not only is the presentation appealing and captivating, but the content is current and relevant so as to hold the attention of elevator riders. Too, the elevator communication system provides useful information to the riders, thus saving the riders' time and creating a more efficient environment. Also, the elevator communication system can entertain the riders, or attract them to events or services. Thereby, the building manager can create revenue by selling advertising space or attracting additional patronage to a building service or event.

These and other features and advantages of the present invention will be appreciated from review of the following detailed description of the invention, along with the accompanying figures in which like reference numerals refer to like parts throughout.

DETAILED DESCRIPTION OF THE INVENTION

Figure 1:
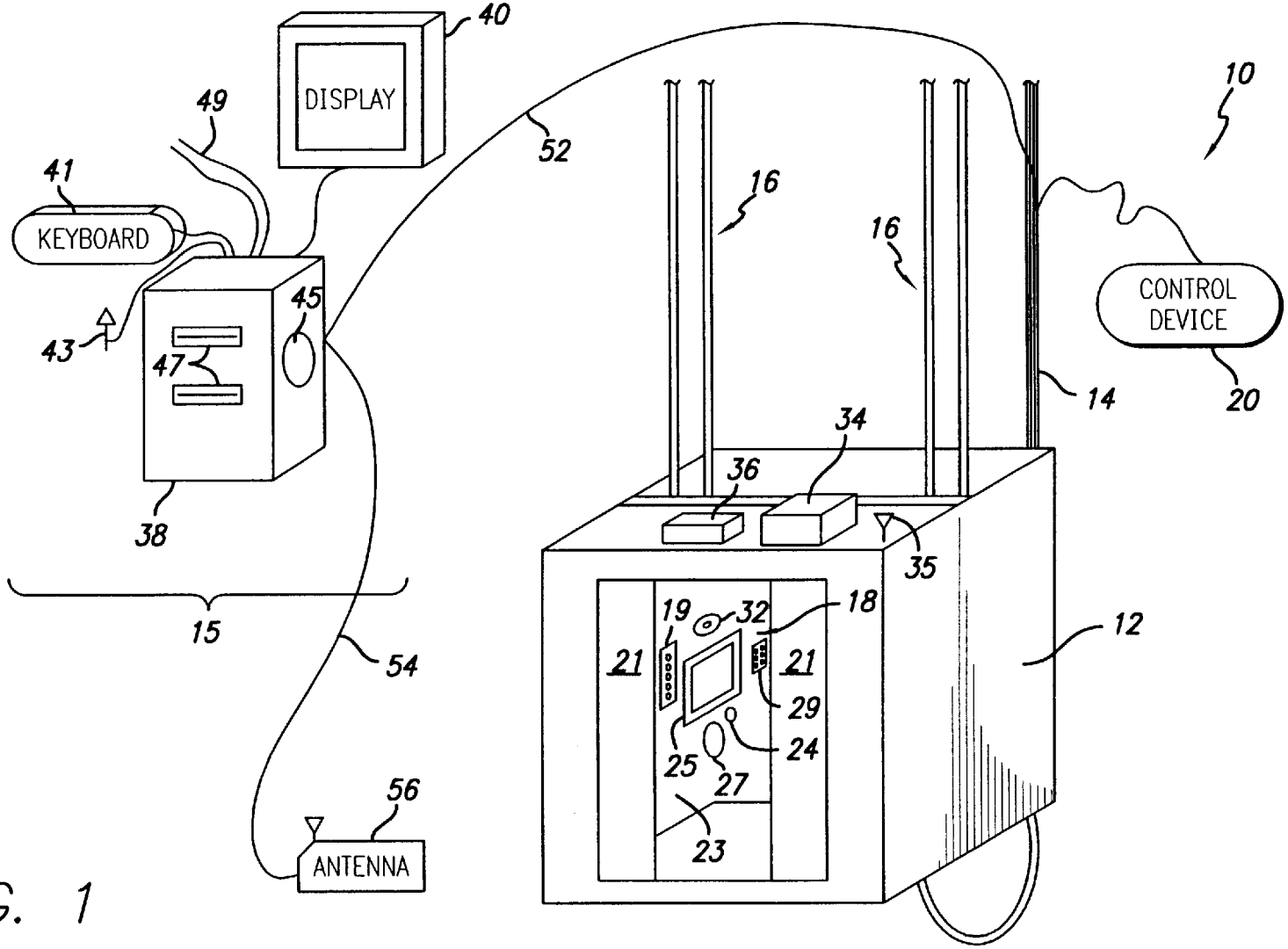
FIG. 1 is a perspective illustration of an elevator communication system made in accordance with the present invention.

In accordance with the present invention, an elevator communication system is provided. Referring to FIG. 1, the elevator communication system 10 is illustrated installed on an elevator cab 12. The elevator cab 12 is generally an enclosed box having sliding doors 21 to provide access to the interior 18 of the cab 12. The cab 12 is propelled in a vertical shaft (not shown) by support cables 16. A wire bundle 14 is flexibly connected to the elevator cab 12 to provide electrical power and a communication link from the cab's elevator controls 19 to a remote elevator control device 20. Although the described example is shown using an elevator cab, any such enclosed transportation is contemplated, such as trolley or train cabs, for example.

The elevator communication system 10 has a computer device 34 installed on the elevator cab 12. The computer device 34 is preferably constructed to be resistant to vibration and shock, so as to withstand the rigors of the elevator environment. Although the computer device is shown mounted to the top surface of the cab, it will be appreciated that the computer device can be installed in alternative positions, such as inside the cab or on the cab walls.

The computer device 34 is also preferably constructed from conveniently available off the shelf component parts, although it will be appreciated that more compact constructions can be made by custom fabricating application specific components. The computer device will generally have a main processing unit, such as an INTEL Pentium class microprocessor (INTEL is a registered trademark of Intel Corp. of Santa Clara, Calif.), and associated support components such as memory and a backplane. The computer device will also use an operating environment, such as MICROSOFT WINDOWS or UNIX (MICROSOFT WINDOWS is a registered trademark of Microsoft Corp. of Redmond, Wash., and UNIX is a registered trademark of AT&T of New York, N.Y.). The operating system not only operates the computer device, but also directs and controls the presentation of information in the cab. It will be appreciated that other processors, components, and operating systems can be substituted.

An uninterruptable power supply (UPS) 36 provides power to the computer device and its peripherals during a power failure. Since a power failure can be a frightening situation in an elevator, it is important the elevator communication system continue operation during any power outage.

The computer device is connected to input and output peripheral devices in the cab's interior 18. For example, the computer device is connected to display 25, speaker 27, camera 32, keypad 29, and microphone 24. It will be appreciate that other peripherals may be substituted depending on the specific information to be presented or collected in the elevator cab.

The display device 25 is preferably a flat LCD (liquid crystal display) panel, such as a TFT (thin film transistor) color display. Constructed as a flat panel device, the display device 25 is conveniently installed on or attached to a cab wall, such as cab wall 23. The display device 25 is configured to present full frame video at 30 frames per second. Such a speed enables a high quality, engaging visual display of information to elevator passengers. The display 25 can also display still images, text and animated information. It will be appreciated that the specific configuration of the display device can be modified for specific application needs.

The speaker 27 is mounted on the cab wall 23 near the display 25. The speaker may present the audio track for a video or graphic being presented, or can provide independent audio, such as an announcement or music. A microphone 24 is mounted adjacent the display 25 for accepting audio input from an elevator passenger. Accordingly, the microphone 24 and the speaker 27 cooperate to enable full-duplex voice communication. Such voice communication may be desirable in an emergency situation, or to instruct the computer device with voice-activated commands, for example.

Also, a keypad 29 or keyboard is provided in the cab 12 for a passenger to input data into the computer device 34. For example, the user may request a map of a particular floor of a building, or want to see the menu from a building restaurant.

A camera 32 may also be mounted in the cab 12. The camera 32 may be used to facilitate live, full-duplex video conferencing with security personnel, for example. Also, the video camera can provide a video feed for monitoring or taping by security personnel to increase security inside the elevator cab. With such a security monitoring presence, vandalism and unruly behavior may be reduced. Further, the data coming from the video camera may be analyzed by the computer device 34 for adjusting the information being displayed to passengers. For example, if the video data suggests an adult entered the elevator with children from a hotel guest floor, the computer device can select to run a video clip to advertise a premier restaurant available at the hotel, and immediately follow with an advertisement for the hotel's babysitting service, for example. Accordingly, the adult may not only use the hotel's babysitting service, but may also dine at one of the hotel's restaurant, thus increasing the hotel's revenues.

The computer device receives much of its informational content from a server system 38. The server system 38 is coupled to the computer device 34 by a communication link, such as data line 52. Data line 52 is a physical connection, such as a 10/100 mbit Ethernet connection, with the data line being incorporated in the wire bundle 14. If it is not possible to use a such a physical connection, the computer server can couple to a LAN antennae 56 through communication line 54. The LAN antennae 56 generates a wireless signal which can be received by cab antennae 35. The cab antennae 35 is connected to a transceiver device (not shown) for converting the wireless signal for use by the computer device 34. In a similar manner, wireless information can be sent from the elevator antennae 35 to the LAN antennae 56. It will be appreciated that various compression techniques can be used to reduce the data traffic on the communications links.

The system server 38 may be localized in the same building or the same campus area as the elevator. For example, the server system 38 may be incorporated with other building support equipment, such as security communication and control systems. Alternatively, the system server may located distant from the elevators. Indeed, the elevator communication system enables a distant server system to control the informational content displayed in many remote elevator cabs. Accordingly, a remotely operated content provider may provide and direct the informational content for several companies, buildings, or stores.

The server system 38 can be used to create and assemble informational content to be presented to cab passengers. Accordingly, the server system 38 has common peripheral devices such as a keyboard 41, microphone 43, speaker 45, and a display 40. The server system also has drives 47 for accessing information from CD ROMS or other magnetic media. The computer system also has a wide area connection 49, such as an Internet connection, for accessing information from other systems, or for receiving current information, such as stock quotes, for example. It will be appreciated that the computer server may be alternatively configured to create or receive other information depending on application specific needs.

Figure 2:
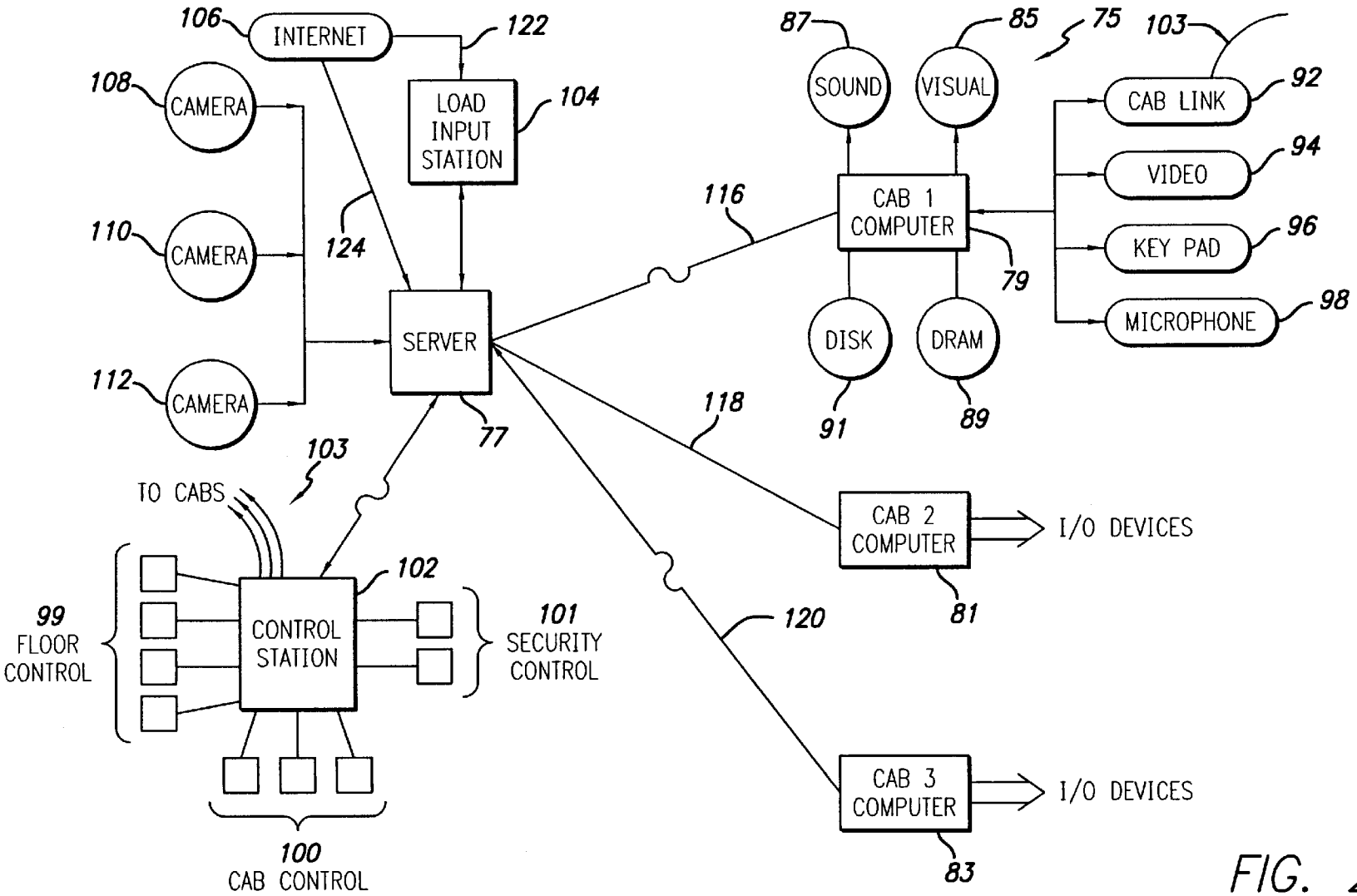
FIG. 2 is a block diagram of an elevator communication system made in accordance with the present invention.

Referring now to FIG. 2, an elevator communication system 75 is shown. The elevator communication system 75 is similar to the elevator communication system 10 described above, except elevator communication system 75 illustrates a multiple cab elevator system. Accordingly, a first cab computer 79, a second cab computer 81, and a third cab computer 83 all couple to a server 77. The server 77 generates and compiles information to be presented in each of the elevator cabs. For example, the server 77 receives input from a local input station 104. The local input station 104 can be, for example, a networked computer device for passing daily conference information to the server 77. Further, an operator at the local input station 104 can access the Internet 106 via connection 122 to download information for presentation. The Internet 106 may also be directly connected to the server 77 for sending streaming data or real-time information for presentation in the cabs.

In another example, the operator may access the Internet to download video clips from a news organization and pass the video clip to the server 77. The server 77 will then communicate the video clip to all or selected cabs for presentation. More specifically, the server 77 can send the video clip to computer 79 by Ethernet communication line 1, to computer 81 via RS232 line 118, or to computer 83 using wireless link 120. In each cab, the video clip is stored locally to optimize display performance and minimize communication line bottlenecks. For example, the video clip can be stored in disk 91. Further, video performance can be enhanced by buffering video data in a DRAM buffer memory 89. When activated by the cab's computer, the video clip can be presented to the passengers using a display and speaker, such as display 85 and speaker 87. Although only computer 79 is illustrated with specific peripherals, it will be appreciated that computer 81 and 83 have similar devices attached. For example, if the communication link from the server 77 to the cab computer 79 has sufficient bandwidth, video and graphical information can be presented without first storing the information on drive 91. Indeed, as the bandwidth is increased, a less powerful cab computer device may be used.

The server 77 is configured to not only send information retrieved and sent by a local input station 104, but the server 77 is also configured to receive and send live data directly from a wide area connection such as internet 106. For example, the server 77 may receive live news or stock information directly off the Internet, and send that information for display in any or all of the elevator cabs. Further, such display may be time sensitive. For example, financial news may be displayed in the early evening when business travelers are using the elevators, but more general news would be displayed in the morning.

Cameras can also provide live video input into the system. For example, video camera 108 may be positioned at the security desk so that security personnel can direct his or her image into the cab. Such an image may assist in calming a passenger if an elevator is stuck, or may provide the necessary "presence" to stop illegal or disturbing behavior by a passenger. Other video cameras, such as cameras 110 and 112, can be positioned so that each camera receives an image of a passageway outside the elevator at each floor. In such a manner, a passenger in a cab can see who is outside the elevator before exiting. If a camera is positioned in a parking garage area, for example, a passenger can verify that a safe exit path exists before leaving the relative safety of the elevator cab. Each of the cameras is preferably a CCD (charge couple device) generating digital video data, but it will be appreciated that other camera systems can be substituted. For example, an analog camera can be used, and the analog video signal converted to a digital signal for communication and storage purposes.

An elevator system also has floor controls 99 located at each floor, a cab control 100 in each cab, and security controls 101 for use by security or emergency personnel. These controls couple to a central elevator control station 102 that directs the travel of each elevator cab via control lines 103. Accordingly, the elevator control station is aware of cab specific information for each cab, such as the position of each cab, the status of the doors, direction of travel, and what floor is the next destination. Typically, the control station 102 or each cab link 103 can be accessed to retrieve at least some of the cab specific information. If the control station can be accessed, then the control station can be directly coupled to the server 77. In such a manner, the server 77 can use the cab specific information to tune the information being presented in each cab. Alternatively, the cab computer, such as computer 103 with cab link 92, can intercept the cab specific data from a control line 103 or an elevator control unit on the cab. Cab link 92 can be, for example, an RS232 connection to cab control circuitry. Using this alternative, the cab computer receives the cab specific information and adjusts the presented information. It will be appreciated that other techniques can be used to capture cab specific information and adjust the presented information.

The computer device 34 is therefore constructed to make elevator-specific decisions on what information to display to elevator passengers. For example, cab specific information, such as current floor and next destination floor can be used to adjust information presented to cab passengers. When stopped at a particular floor, directional information can be presented for that floor. When the doors close and the elevator is moving to the next destination floor, a map of the destination floor can be shown, along with audio descriptions, to facilitate navigating the destination floor. It will be appreciated that cab specific information can be used in a multitude of ways to adjust the information presented to cab passengers.

Cab computer 79 also has a video camera input 94, keypad 96, and microphone 98. Accordingly, a fall duplex audio and video communication can be established between passengers in the elevator cab and security personnel, for example. Such a link would be advantageous in an emergency or stressful situation.

Figure 3:
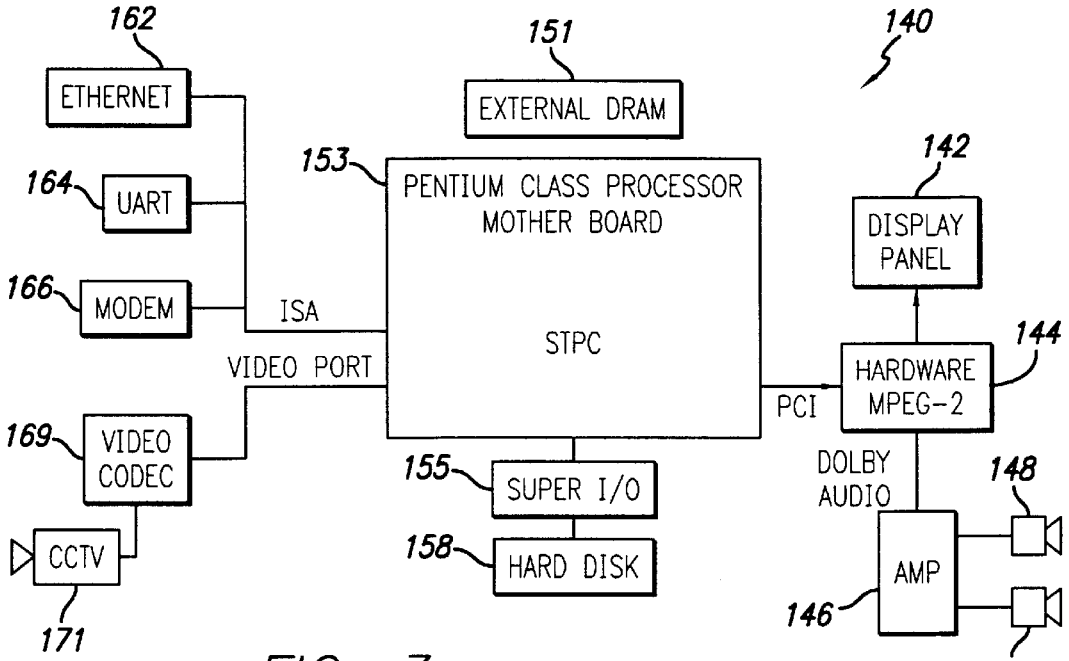
FIG. 3 is a block diagram of a computer device made in accordance with the present invention for use in an elevator cab.

Referring now to FIG. 3, a specific example of a cab computer 140 is shown. The cab computer 140 is similar to cab computer 89 discussed above. Cab computer 140 has a main processor 153, DRAM 151 for buffering video data, and a fast I/O card communicating with a hard disk 158. A multimedia card 144 drives the display panel 142 and the speaker 148, which may be amplified by amplifier 146. An Ethernet connector 162, an RS232/422/485 port connector 164, and a modem connection are included in the processor 153, usually on the motherboard or as a card in a backplane. A high-speed digital video card 169 accepts video data from a video camera 171. Although a particular example of the cab computer is illustrated, it will be appreciated that other configurations and communication devices can be substituted.

Figure 4:
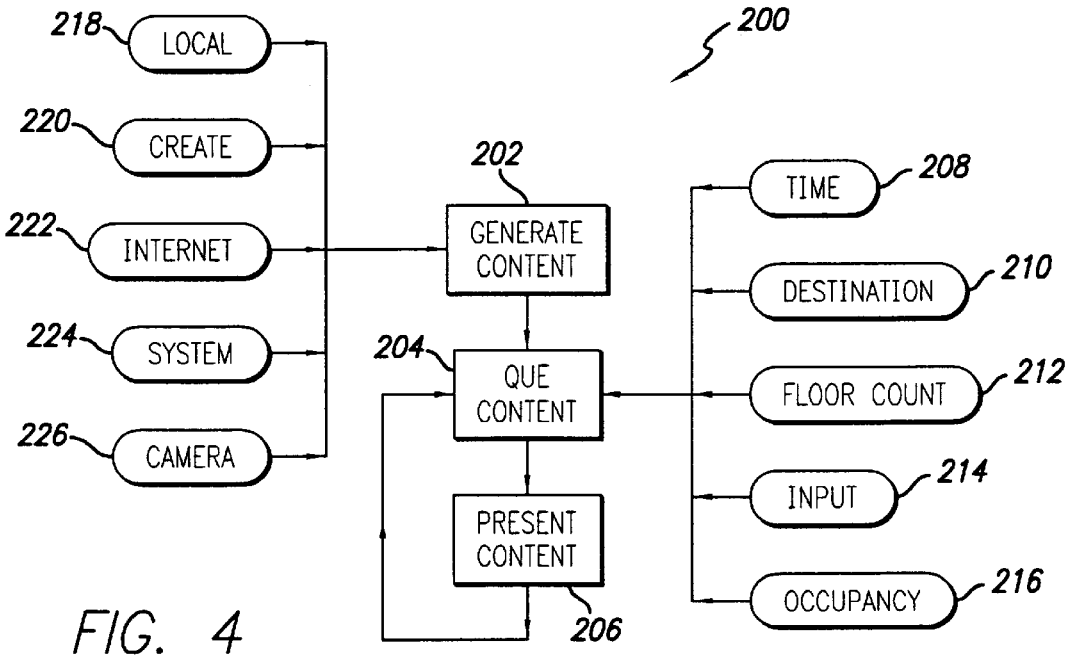
FIG. 4 is a flowchart of a method of presenting information in an elevator cab in accordance with the present invention.

FIG. 4 is a flowchart of a process to generate, queue, and present information to passengers in an elevator cab. The general construct of the data flow is that informational content is generated as shown in block 202, the information is queued for presentation in block 204, and the informational content is presented to cab passengers in block 206. Each of these general blocks is described in more detail below.

Block 202 shows generally that informational content is generated. This content can be derived from several sources, such as those shown as inputs to block 202. Local content 218, such as daily conference information or daily specials can be generated. Other local content could be real-time inputs such as local time or temperature. In another example, the hotel registration system could provide a local input. Accordingly, immediately after a guest for a particular convention checks in and enters his or her assigned floor into an elevator control, the elevator communication system can present convention information to that guest as the guest rides to his or her floor.

Content can also be created 220, such as floor maps or local advertisements. Information received from the Internet can facilitate creating such content. Further, the Internet 222 can directly provide content in the form of streaming data or live information feeds. The elevator system 224 can also generate data, such as emergency information, floor information, or security information. For example, the system can report that there is a security problem in the lobby, and direct the elevators to unload all passengers in a parking garage. In such a manner, the passengers could be fully informed and comfortable with the situation before arriving in the garage. Cameras 226, such as a camera for use by security personnel or a camera fixed at a destination floor, also provide content into the elevator communication system.

Figure 6:
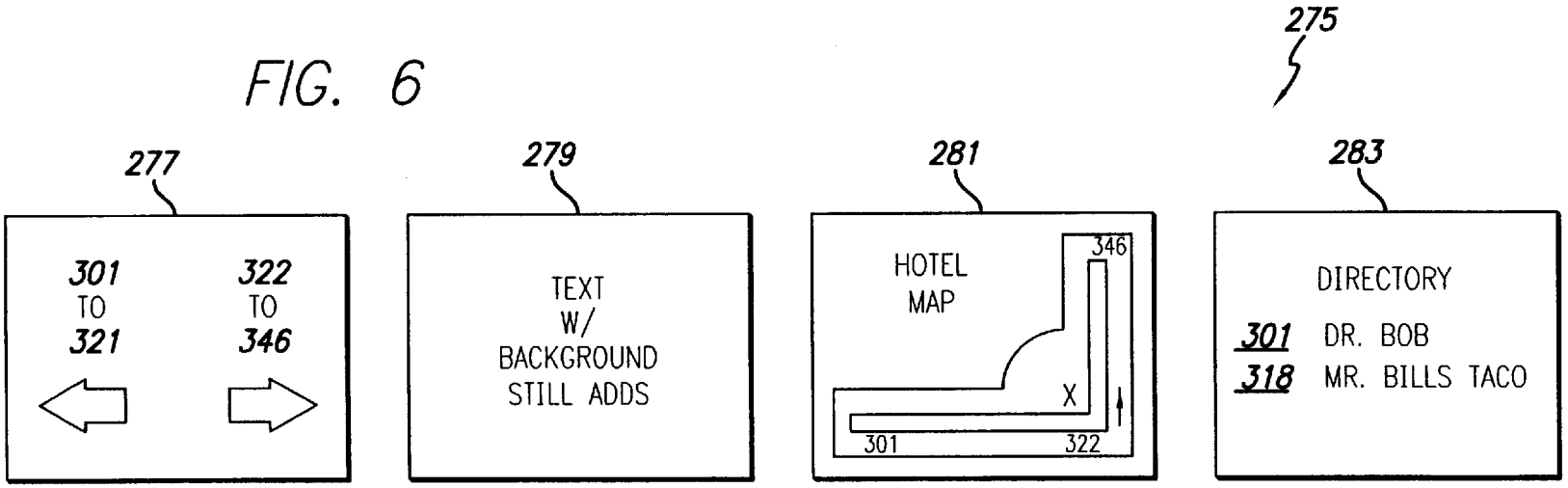
FIG. 6 illustrates example indicia for display in an elevator cab using an elevator communication system made in accordance with the present invention.

Once generated, the content must be queued for presentation. Some content can be defined as background content, which would remain queued and presented unless specifically directed by the elevator communication system. For example, a live Internet news feed can be the default content unless interrupted by more pressing content. In another example, text or still ads, as illustrated in FIG. 6 by indicia 279, can be the default presentation. The queuing of content may be done responsive to received selection data. Time 208, floor destination 210, floor count 212, passenger input 214, and occupancy level 216 are examples of selection data for adjusting the queue of information content to be presented. It will be appreciated that other selection criteria may be used according to specific application needs.

Content may be adjusted by selection data in the form of time 208. For example, morning riders may be interested in the day's developing news, whereas evening riders may want to get a view and report on traffic conditions for the roadways. In another example, weekend patrons will have a different interest than weekday riders.

Also, the destination floor 210 can affect what content is queued. When a particular floor is selected as the destination floor, a directional sign, such as directional indicia 277 may be shown before arriving at the destination floor. Alternatively, a map, such as map indicia 281 can be queued. Even a directory of services or offices on the destination floor can be queued, as shown in indicia 283. Also, the queued content can be adjusted by what floors are not selected. For example, if an elevator cab's next destination passes by a particular floor in a multifloor retail outlet, the elevator can quickly queue up a reminder to passengers to stop on the yet unselected floor. In another scenario, different content can be queued depending on from which floor passengers entered the elevator. For example, if the elevator picks hotel guests up from the workout-room floor, then the elevator communication system may queue a video clip from the hotel's sports bar.

Also, an elevator rider may be able to generate selection data for the elevator communication system. A keypad, keyboard, mouse control, or even a voice-activated system can accept inputs from a rider. The user can request menus, directions, or security assistance, each of which will cause different information to be queued. Floor count, 212 can also affect queued information. If the elevator is scheduled to move only a few floors before stopping, only a short informational clip may be queued. However, if the elevator is scheduled for a longer run, then a longer segment can be displayed.

Selection data indicative of the occupancy 216 or number of people in the cab can also adjust the content. The number of people may be roughly calculated by floor stops and cab control inputs, by analysis of the video feed, or by sound level in the cab. For a larger group, a louder, and more visually stimulating presentation would more effectively hold the attention of the riders. Conversely, a single person or a small group may be more responsive to a more refined, softer message.

Figure 5:
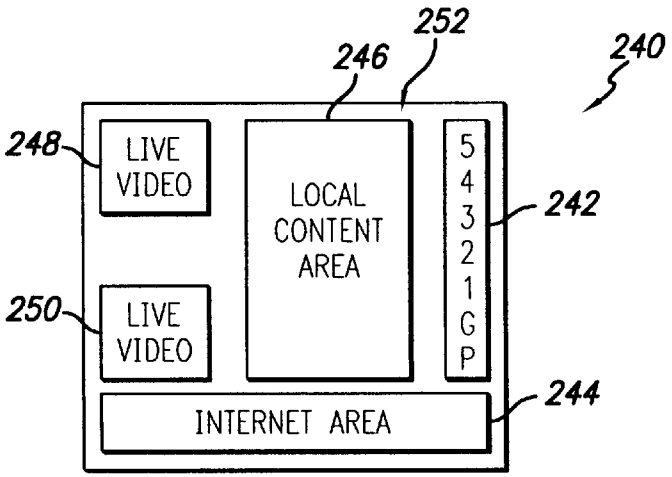
FIG. 5 is an example display for use with a computer device made in accordance with the present invention.

Once queued, the information is presented in block 206. The visual information can be presented in a display, such as the display 240 shown in FIG. 5. The display 240 has a display area 252 divided into particular display areas. For example, floor display 242 may show the next destination floor, including which floors will be stopped at to allow additional passengers into the cab. Live Internet area 244 may show live feed from a news organization, such as live stock quotes. The main local area 246 may show advertisements, floor maps, or directory information as described earlier. Live camera areas 248 and 250 may show live video from, for example, the area outside the next destination floors. Periodically, for example every 10 seconds, the elevator communication system checks if new information is queued. If so, the new content is accessed and presented in the elevator cab.

The disclosed elevator communications system is useful for creating a safer and more pleasant experience for elevator riders. Not only is the aesthetics of the ride improved, but the system is also able to entertain and provide important information to the riders. Further, the elevator communications system provides additional revenue possibilities through the sale of advertising and the attraction of additional patronage to building services and attractions.

One skilled in the art will appreciate that the present invention can be practiced by other than the preferred embodiments which are presented in this description for purposes of illustration and not of limitation, and the present invention is limited only by the claims which follow. It is noted that equivalents for the particular embodiments discussed in this description may practice the invention as well.

What is claimed is:

1. An elevator communications system, comprising:

a cab computer constructed to be attached to an elevator cab, the cab computer coupled to an elevator control system;

a display coupled to the cab computer and positioned inside the elevator cab;

an audio speaker coupled to the cab computer and positioned inside the elevator cab;

a server communicating with the cab computer, the server containing information content; and wherein the cab computer performs the steps of receiving data from the elevator control system; and presenting the information content based on the data received from the elevator control system.

2. The elevator communications system according to claim 1, further including a keypad in the cab, and wherein the keypad is used to present specific information content.

3. The elevator communications system according to claim 1, further including a microphone in the cab, and wherein a voice command received from the microphone is used to selectively present specific information content and communicate with individuals outside the elevator.

4. The elevator communications system according to claim 1, further including a video camera in the cab generating video data, and wherein the video data is used to by the cab computer to select and present specific information content.

5. The elevator communications system according to claim 1, further including a video camera in the cab generating video data and coupled to a communication link to a security console, wherein the video data is communicated to a display at the security console.

6. The elevator communications system according to claim 1, further including an Internet communication line coupled to the server receiving streaming informational content, wherein the server routes the streaming informational content received from the Internet to the cab computer.

7. The elevator communications system according to claim 6, wherein the presenting includes displaying the streaming information content on the display.

8. The elevator communications system according to claim 1, further including a LAN antennae connected to the server and a cab antennae connected to the cab computer, wherein a wireless communication link is established between the server and the cab computer.

9. The elevator communications system according to claim 1, further including a communication wire coupling the server to the cab computer, the communication wire being in a wire bundle coupled to the cab, wherein a physical communication link is established between the server and the cab computer.

10. The elevator communications system according to claim 1, further including a second cab computer coupled to the server so that the server sends informational content to both the cab computer and the second cab computer.

11. The elevator communications system according to claim 1, further including a disk on the cab and coupled to the cab computer, the disk being configured to store informational content.

12. The elevator communications system according to claim 1 further including a communication link having a sufficient bandwidth between the server and the cab computer so that the server can send visual data to the cab computer, and the cab computer can directly drive the display, without storing the visual data on a disk drive on the elevator cab.

13. The elevator communications system according to claim 1 further including a camera mounted remote from the cab and directed toward a passageway near an exit to the elevator cab, the camera being coupled to the server.

14. The elevator communications system according to claim 1 further including a camera mounted remote from the cab and directed toward a security person, the camera being coupled to the server.

15. A method of presenting informational content in an elevator cab, comprising:

generating at least a portion of the informational content at a location physically remote from the elevator cab;

accepting the informational content locally at the elevator cab, including the portion generated remote from the elevator cab;

receiving selection data from at least the elevator control system;

queuing, responsive to receiving the selection data, portions of the informational content for presentation in the elevator cab.

16. The method of presenting according to claim 15 wherein receiving the selection data includes receiving time data.

17. The method of presenting according to claim 15 wherein receiving the selection data includes receiving date data.

18. The method of presenting according to claim 15 wherein receiving the selection data includes receiving cab specific data.

19. The method of presenting according to claim 12 wherein receiving the cab specific data includes receiving next floor destination data.

20. The method of presenting according to claim 12 wherein receiving the cab specific data includes receiving floor count data.

21. The method of presenting according to claim 12 wherein receiving the cab specific data includes receiving occupancy data.

22. The method of presenting according to claim 15 wherein receiving the selection data includes receiving data from a keypad or microphone.

23. The method of presenting according to claim 15 further including receiving a portion of the information content as streaming data from the Internet.

24. The method of presenting according to claim 15 wherein a portion of the informational content is received from a video camera.

25. The method of presenting according to claim 24, further including mounting the camera to monitor a position outside doors to the elevator cab.

26. The method of presenting according to claim 24, further including mounting the camera at a position to generate data indicative of a security person.

* * * * *